US005165393A

United States Patent [19]

Kawaguchi

[11] Patent Number: 5,165,393

[45] Date of Patent: Nov. 24, 1992

[54] DEEP BREATHING EXERCISE APPARATUS

[75] Inventor: Hirozumi Kawaguchi, Arita, Japan

[73] Assignee: Kawaei Co., Ltd., Wakayama, Japan

[21] Appl. No.: 671,965

[22] Filed: Mar. 18, 1991

[51] Int. Cl.[5] ..... A61M 15/00; A62B 18/00; A62B 7/00; A63B 23/00

[52] U.S. Cl. ..... 128/200.24; 482/13

[58] Field of Search ..... 128/200.24, 207.14, 128/207.16, 205.24, 205.17, 204.28, 203.28, 205.13, 914; 272/99

[56] References Cited

U.S. PATENT DOCUMENTS

| | | | |
|---|---|---|---|
| 3,333,844 | 8/1967 | Jurschak | 272/99 |
| 3,511,228 | 5/1970 | Lundgren et al. | 272/99 |
| 3,669,097 | 6/1972 | Fitz | 272/99 |
| 3,867,770 | 2/1975 | Davis | 272/99 |
| 3,949,984 | 4/1976 | Navara | 272/99 |
| 4,441,506 | 4/1984 | McCombs et al. | 272/99 |
| 4,473,082 | 9/1984 | Gereg | 272/99 |

*Primary Examiner*—Edgar S. Burr
*Assistant Examiner*—Kimberly L. Asher
*Attorney, Agent, or Firm*—Wenderoth, Lind & Ponack

[57] ABSTRACT

An apparatus is provided for use in deep breathing exercises and includes a bag capable of expanding and contracting, a pipe connected to the bag for allowing air to be blown into the bag, and a check valve provided at an outlet hole of the pipe. At least the air outlet hole of the pipe and the check valve are formed of an elastic material so that the air collected in the bag can escape when the check valve is opened by elastically deforming the pipe adjacent the air outlet hole and the check valve, and so that the escape of the air is stopped when the check valve is closed due to elastic return of the pipe and the check valve. Accordingly, opening and closing of the check valve can be easily carried out so that deep breathing to improve health can be mastered irrespective of age or sex. Further, since a user can visibly ascertain to what degree he has exhaled the air by viewing the expansion of the rubber balloon, he will be convinced of the advantageous effects of practicing deep breathing, such that he will be motivated to continue practice and thereby improve his health.

9 Claims, 4 Drawing Sheets

DEEP BREATHING EXERCISE APPARATUS

BACKGROUND OF THE INVENTION

1. Field of the Invention

The present invention relates to an apparatus for use in deep breathing exercises.

2. Prior Art

It is well known that oxygen is necessary for human brain cells to actively function.

It is also well known that taking ample oxygen into one's body is good for maintaining one's health.

Oxygen must be taken into the body in the first place in order to provide oxygen to the brain cells. The taking in of large amounts of oxygen can be carried out by unconscious harsh breathing due to active physical movement and by conscious deep breathing.

However, most oxygen taken into the body by means of harsh breathing after active physical movement is supplied to the muscular tissue, such that not very much oxygen is carried to the brain.

Taking a deep breath while performing little physical movement is very effective since a superfluous amount of oxygen is taken into the body. However it is very difficult to consciously take a deep breath in the present busy social environment.

SUMMARY OF THE INVENTION

For the purpose of overcoming the abovementioned conventional problems, the present invention is to offer an apparatus for easily consciously performing deep breathing exercises, by which continuous practice of deep breathing can be easily carried out for a certain period of time, and by which abdominal muscular pressure necessary to live can be increased and the effect of the increased abdominal muscular pressure can become easily seen.

The inventor, as a result of his research, revealed the fact that by practicing deep breathing (abdominal breathing) as a fundamental way to maintain one's health, abdominal muscular pressure and temperature can be raised, digestion and absorption of foods can be improved, and all physical functions can be activated, to thereby promote health. However, it is difficult to properly practice deep breathing in everyday life. It has been determined that such difficulty results from a difficulty in continuing to practice deep breathing, even though it is recognized to be good for health, since in consciously practicing deep breathing in ordinary life, exhaled breath is invisible and the amount of the exhaled breath cannot be confirmed.

The inventor's further research determined that proper breathing can be mastered by expanding a balloon-like bag made for practicing proper breathing, and the present invention was thus completed.

According to the present invention, an apparatus is provided for use in deep breathing exercises and comprises a bag capable of expanding and contracting, a pipe for blowing air, an end of which is connected with the inlet of the bag, and a check valve for opening and closing an air-blow-off hole of the pipe. At least the air-blow-off hole of the pipe and the portion of the pipe adjacent the check valve are formed of an elastic material in order to allow a counter flow of the air from the bag to the pipe during elastic deformation of the air-blow-off hole and the check valve, and a counter flow of the air from the bag to the pipe is prevented during elastic return of the air air-blow-off and the check valve.

DETAILED DESCRIPTION OF THE PREFERRED EMBODIMENT

A first preferred embodiment of the present invention will now be explained with reference to FIGS. 1 through 4.

Figure 1:
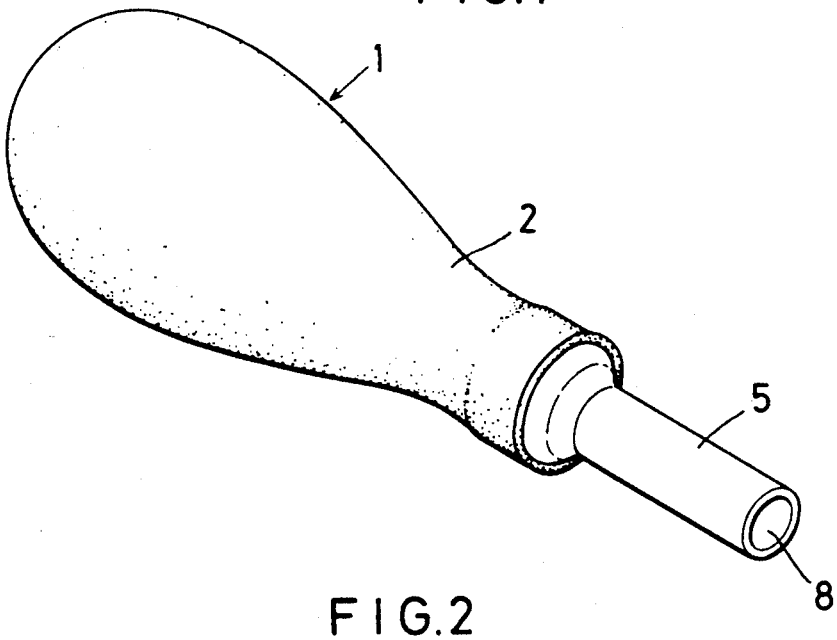
FIG. 1 is a perspective view showing a deep breathing exercise according to a first example of the present invention.

As shown in FIG. 1, a deep breathing exercise apparatus basically comprises a bag 2 capable of expanding and contracting, a pipe 5 through which air is to be blown, and a check valve 10. The bag 2 is formed of a material capable of being expanded by air blown thereinto, and in this example a rubber balloon is employed.

Figure 2:
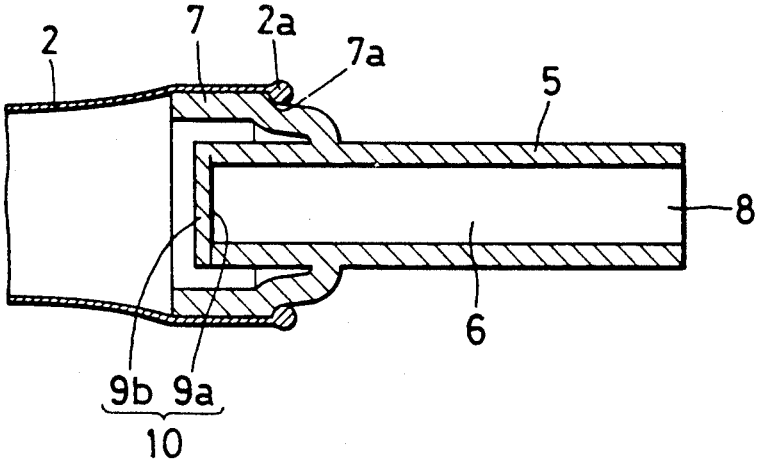
FIG. 2 is an enlarged longitudinal sectional view of main components of the apparatus shown in FIG. 1.

The pipe 5 is formed of a soft synthetic resin such as rubber, urethane or the like and includes, as shown in FIG. 2, an air passage 6, an air inlet 8, the check valve 10 and a flange part 7.

On the other hand, the check valve 10 for opening and closing an air outlet hole 9*a* is provided at an end of the pipe 5. The check valve 10 includes the valve hole which defines the air outlet hole 9*a*, and a bellows-like valve plug 9*b* for opening and closing the valve hole 9*a*.

At the outer periphery of the pipe 5, the flange part 7 having substantially an L-shaped section is formed about the periphery of the pipe. The inlet end 2*a* of the rubber balloon 2 is engaged about the outer surface of the flange part 7 and held securely by a stepped portion 7*a*.

The entire pipe 5 is formed integrally of soft synthetic resin and, as is described later, elastic deformation of the flange part 7 and the check valve 10 allows the air to counter flow from the rubber balloon 2 to the inside of the pipe 5 and elastic return of the flange part 7 and the check valve 10 stops the counter flow of air from the rubber balloon 2 to the pipe 5.

The operation of the abovementioned example will now be explained.

Figure 3:
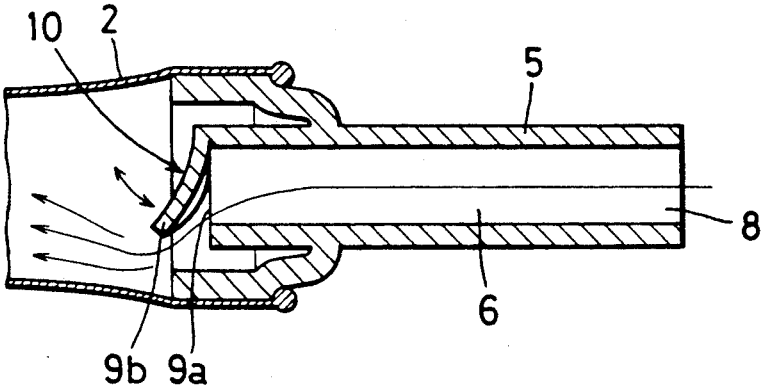
FIG. 3 is an enlarged longitudinal sectional view similar to FIG. 2, but showing a check valve in its open position.

First, a user holds the pipe 5 with the inlet hole 8 in his mouth, and after inhaling air deeply, he blows the air into the inlet hole 8 such that the blown air opens the valve plug **9*b* and flows into the rubber balloon 2 as shown in FIG. 3. The rubber balloon 2** is thus expanded.

At this time, even if the user stops blowing or his mouth is detached from the inlet hole 8, the check valve 10 functions to prevent a counter flow of the air from the rubber balloon 2 and out through the pipe, such that the rubber balloon 2 is maintained expanded.

The air is repeatedly blown into the rubber balloon 2 in this manner, such that the balloon 2 becomes considerably enlarged.

Figure 4:
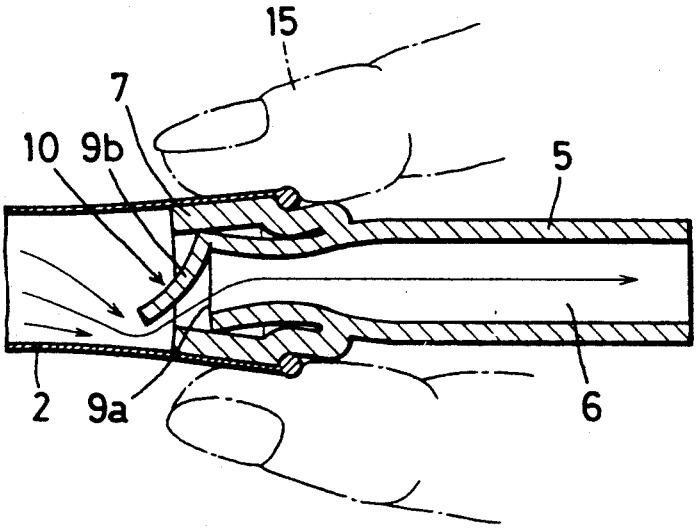
FIG. 4 is a longitudinal sectional view of the apparatus for explaining the operation of the check valve.

When the rubber balloon 2 reaches a certain size, the flange part 7 is compressed between the user's fingers 15 as illustrated in FIG. 4. Due to this, the flange part 7 and the check valve 10 are deformed elastically into a flat shape to cause the valve plug **9*b* to separate from the valve hole 9*a* and cause air in the balloon 2 to leak through the valve 10 and out through the pipe 5. Accordingly, the air collected in the rubber balloon 2 flows backward in the direction shown by arrows in FIG. 4 and the balloon 2** contracts quickly.

After letting the air out of the rubber balloon 2 in this manner, the compression of the flange part 7 with the fingers 15 is relaxed. Due to this, the flange part 7 and the portion of the pipe 5 adjacent the check valve 10 is elastically returned, such that the check valve 10 is closed and returned to its original position.

According to the aforementioned structure, the check valve 10 can be opened and closed by the simple operation of compressing the flange part 7 of the pipe 5 between the fingers. Accordingly, anyone can use this apparatus. Therefore, as a result of promoting practicing of deep breathing, the apparatus of the present invention causes the abdominal muscular pressure necessary for maintaining one's health to be increased, his temperature to be properly maintained, and his digestion and absorption of foods to be improved, to thereby improve his health. Further, since sufficient oxygen is always supplied to his brain, the brain can be kept clear.

Further, since the user can know at a glance to what degree he has exhaled the air by looking at the degree of expansion of the rubber balloon 2, he will be convinced of the advantageous effects of practicing deep breathing, so that he will be motivated to continue to practice and thereby improve his health.

Moreover, when the air is let out of the rubber balloon 2 such that the balloon 2 is contracted, this apparatus is convenient for portable use. Therefore, even when travelling or the like, this apparatus can easily be put in a bag so that deep breathing can be carried out anywhere, thus increasing the practical value of the apparatus.

In the present embodiment, the entire pipe 5 is formed integrally of soft synthetic resin, therefore the production thereof is simple. Further, since the valve plug 9 of the check valve 10 can be formed by only providing a cut at the end of the pipe 5, the production process is simplified and the production cost can be decreased.

Figure 5:
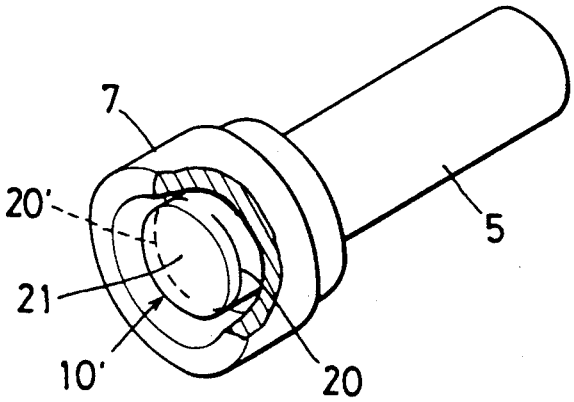
FIG. 5 is a perspective view showing a second example according of the apparatus to the present invention.
Figure 6:
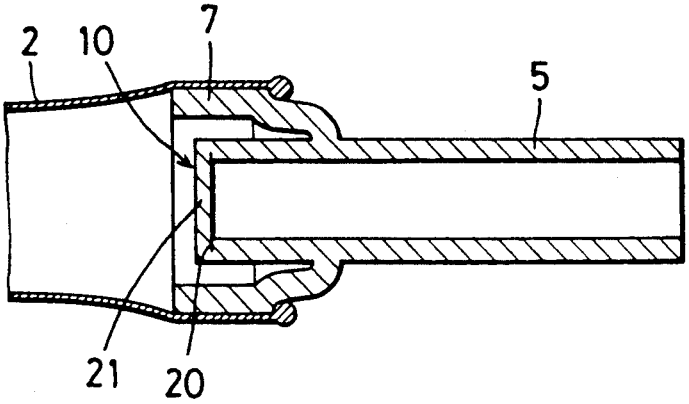
FIG. 6 is an enlarged longitudinal sectional view of the apparatus shown in FIG. 5 with its check valve in a closed position.
Figure 7:
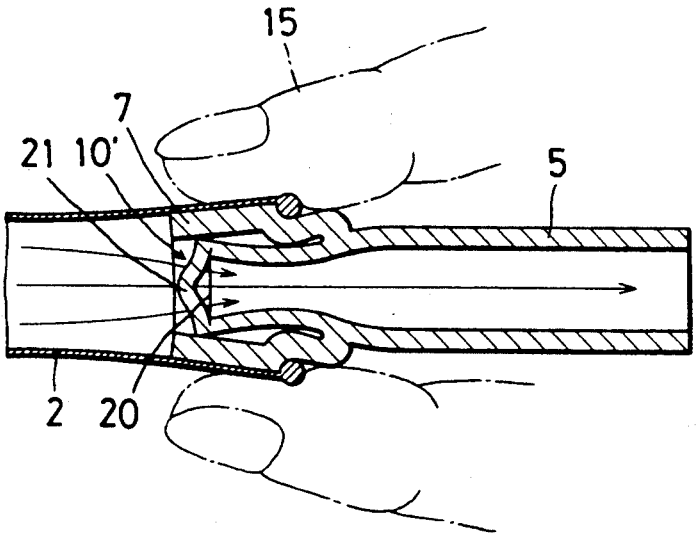
FIG. 7 is an enlarged longitudinal sectional view showing the apparatus of FIG. 5 with the check valve in an open position.

FIGS. 5 through 7 illustrate a second example of the present invention. In this example, cuts 20, 20' are formed, leaving upper and lower parts of a valve plug 21 uncut so that, as shown in FIG. 7, upon compressing a flange part 7, the center of the valve plug 21 protrudes forwardly to open a valve hole. Thus, in the same manner as described in the aforementioned first example, opening and closing of a check valve 10' can be carried out easily.

Figure 8:
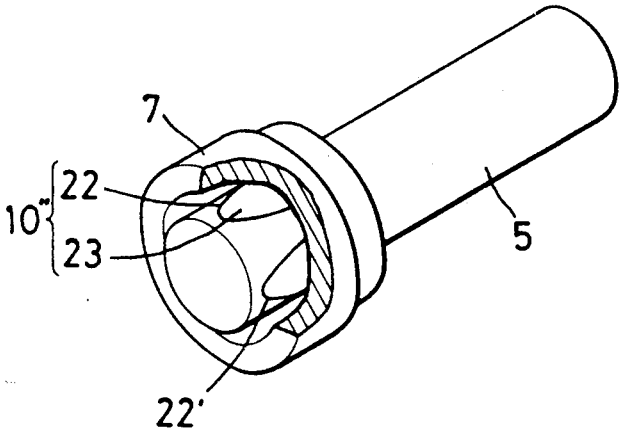
FIG. 8 is a perspective view of a third example of the apparatus according to the present invention.
Figure 9:
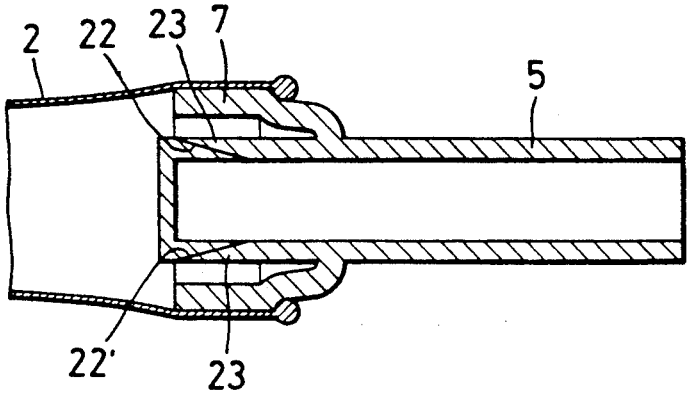
FIG. 9 is a sectional view of the third example shown in FIG. 8.
Figure 10:
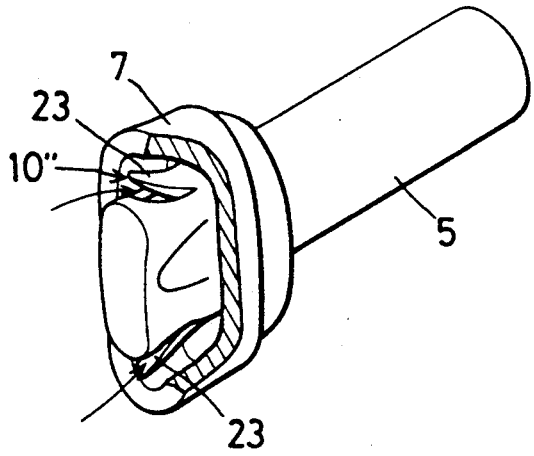
FIG. 10 is a schematic perspective view showing the apparatus of FIG. 8 with its check valve in an open position.

FIGS. 8 through 10 illustrate a third example of the present invention. In this example, a plurality of cuts 22, 22' are formed at the sides of a pipe 5 rather than the end thereof to form air outlet holes. Accordingly, as shown in FIG. 10, each valve plug 23 is opened when a flange part 7 is elastically deformed into a flat shape by compressing the flange part 7. Thus, in the same manner as described in the aforementioned first example, opening and closing of each of the check valves 10'' can be carried out easily. In this example, however, unlike the first and second examples, the check valves 23 can be opened to allow air to be blown into the rubber balloon 2 in a smooth manner not only when contracting the rubber balloon 2, but also when expanding it.

Figure 11:
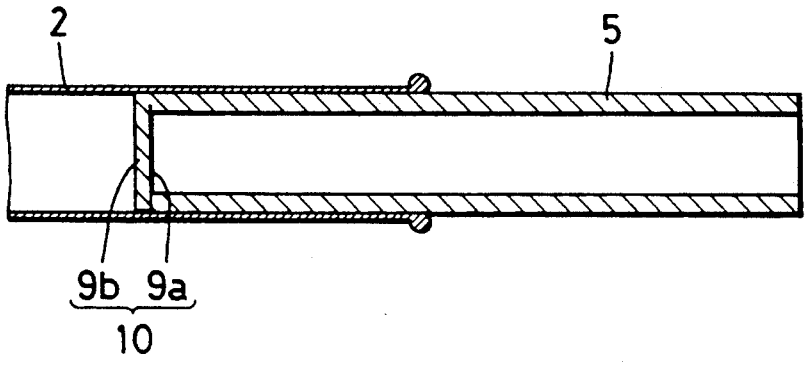
FIG. 11 is a longitudinal sectional view showing a fourth example of the apparatus according to the present invention.
Figure 12:
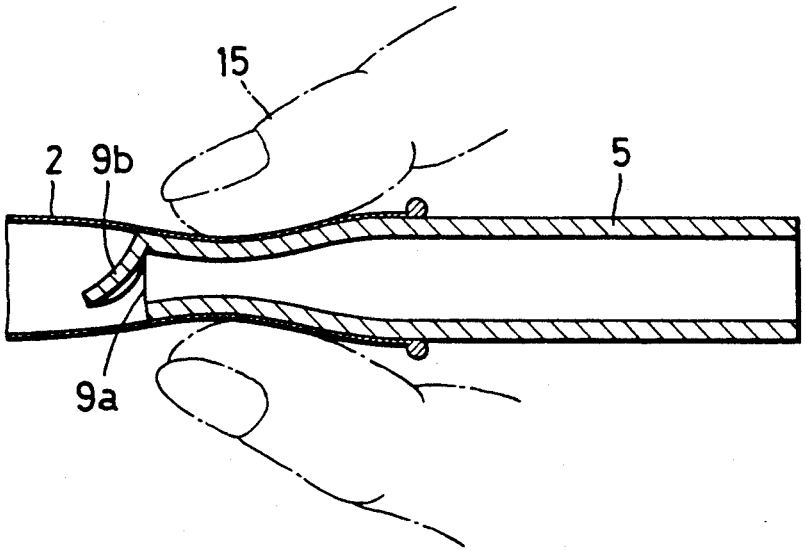
FIG. 12 is a longitudinal sectional view showing the apparatus of FIG. 11 with its check valve in an open position.

In a fourth example of the present invention, as illustrated in FIGS. 11 and 12, a rubber balloon 2 may be mounted directly on an end of a pipe 5. In this case, a check valve 10 can be opened and closed by elastic deformation thereof in the same manner as described in each of the aforementioned examples.

In each of the aforementioned examples, the bag 2 has been described as a rubber balloon. However, any other materials which can be expand by blowing air thereinto may be employed. For example, a paper bag may be employed. Since a paper bag, unlike a rubber balloon, does not automatically contract, the user must manually force its contraction.

In each of the aforementioned examples, the pipe 5 is formed integrally of soft synthetic resin, but a hard material may be used to form the portion of the pipe 5 adjacent the air outlet hole.

As explained above, according to the present invention, a check valve is opened and closed by elastic deformation of the pipe and the check valve, such that the operation of opening and closing the check valve can be carried out easily. Accordingly, this apparatus can be used irrespective of the age or sex of the user. Therefore, as a result of practicing deep breathing, the abdominal muscular pressure necessary for maintaining one's health is increased, his temperature is properly maintained, and his digestion and absorption of foods can be improved to thereby improve his overall health. Further, since sufficient oxygen is always supplied to his brain, the brain can be kept clear.

Moreover, since the user can know at a glance to what degree he has exhaled the air by looking at the degree of expansion of the rubber balloon, he will be convinced of the advantageous effects of practicing deep breathing, so that he will be motivated to continue to practice and thereby improve his health.

Further, when the air is let out of the bag such that the bag is contracted, this apparatus is convenient for portable use. Therefore, even when travelling or the like, this apparatus can easily be put in a bag so that deep breathing can be carried out anywhere, thus increasing the practical value of the apparatus.

What is claimed is:

1. A deep breathing exercise apparatus comprising:

a bag which is capable of expanding and contracting and which has an air inlet end;

an elongated pipe having a first end connected to said inlet end of said bag, a second end with an air inlet hole, and an air passageway extending from said first end to said second end;

wherein at least a portion of said pipe adjacent said first end is formed of an elastic material, such that said portion of said pipe adjacent said first end thereof can be maintained in a non-deformed condition and selectively compressed into a deformed condition;

wherein said portion of said pipe adjacent said first end thereof is provided with an air outlet hole through which air can be blown from said air passageway into said bag, and a check valve means for allowing air to be blown through said air outlet hole into said bag, for preventing air from escaping from said bag through said air outlet hole when said portion of said pipe adjacent said first end thereof is in said non-deformed condition, and for allowing air to escape from said bag through said air outlet when said portion of said pipe adjacent said first end thereof is in said deformed condition; and wherein said air outlet hole and said check valve means is formed by a plurality of side cuts formed through a sidewall of said pipe.

2. A deep breathing exercise apparatus as recited in claim 1, further comprising a flange formed about a periphery of said portion of said pipe adjacent said first end thereof, said flange defining a means for connecting said bag to said first end of said pipe and for compressing said portion of said pipe adjacent said first end thereof into said deformed condition.

3. A deep breathing exercise apparatus as recited in claim 2, wherein said flange extends toward said first end of said pipe from a location on said pipe spaced from said first end thereof.

4. A deep breathing exercise apparatus as recited in claim 3, wherein said flange includes a stepped portion about a periphery thereof; and said air inlet end is connected to said flange about said stepped portion.

5. A deep breathing exercise apparatus as recited in claim 1, wherein said pipe includes a valve plug covering said first end thereof.

6. A deep breathing exercise apparatus as recited in claim 5, wherein said side cuts are formed immediately adjacent said valve plug, such that, in said deformed condition, a central portion of said valve plug protrudes longitudinally away from said pipe.

7. A deep breathing exercise apparatus as recited in claim 1, wherein said side cuts are formed through said sidewall of said pipe in a direction perpendicular to a longitudinal direction of said pipe.

8. A deep breathing exercise apparatus as recited in claim 1, wherein said side cuts are taper cuts formed through said sidewall of said pipe from an outer periphery thereof and tapered radially inwardly and toward said second end of said pipe.

9. A deep breathing exercise apparatus as recited in claim 1, wherein said bag comprises an elastic balloon.

* * * * *